US011819465B2

(12) United States Patent
Cohen

(10) Patent No.: US 11,819,465 B2
(45) Date of Patent: Nov. 21, 2023

(54) LIFT CHAIR ASSEMBLY

(71) Applicant: Gregg Cohen, Dallas, TX (US)

(72) Inventor: Gregg Cohen, Dallas, TX (US)

( * ) Notice: Subject to any disclaimer, the term of this patent is extended or adjusted under 35 U.S.C. 154(b) by 292 days.

(21) Appl. No.: 16/928,287

(22) Filed: Jul. 14, 2020

(65) Prior Publication Data

US 2022/0015970 A1 Jan. 20, 2022

(51) Int. Cl.

| | |
|---|---|
| ***A61G 5/14*** | (2006.01) |
| ***A61G 5/10*** | (2006.01) |
| ***A47C 1/032*** | (2006.01) |
| ***A47C 1/024*** | (2006.01) |
| *A61G 7/053* | (2006.01) |
| *A61G 7/10* | (2006.01) |
| *A47C 7/00* | (2006.01) |
| *A47C 7/62* | (2006.01) |

(52) U.S. Cl.

CPC ..... *A61G 5/14* (2013.01); *A47C 1/024* (2013.01); *A47C 1/03205* (2013.01); *A61G 5/107* (2013.01); *A61G 5/1072* (2013.01); *A47C 7/002* (2013.01); *A47C 7/62* (2013.01); *A61G 7/053* (2013.01); *A61G 7/1019* (2013.01)

(58) Field of Classification Search

None

See application file for complete search history.

(56) References Cited

U.S. PATENT DOCUMENTS

| | | | | |
|---|---|---|---|---|
| 4,099,776 | A * | 7/1978 | Crum | A47C 1/0347 297/68 |
| 4,778,217 | A * | 10/1988 | Lane | A61G 5/14 297/DIG. 10 |
| 5,178,025 | A * | 1/1993 | Bennett | A61G 5/14 74/105 |
| 5,186,518 | A * | 2/1993 | Pine | A47C 1/0355 297/85 L |
| 5,312,153 | A * | 5/1994 | Lin | A47C 1/0345 297/DIG. 10 |
| 6,692,051 | B1 * | 2/2004 | Cook | B60N 2/24 296/24.39 |
| 8,398,171 | B2 * | 3/2013 | Lin | A61G 5/14 297/DIG. 10 |
| 8,424,966 | B1 * | 4/2013 | May | A47C 15/002 297/344.22 |
| 8,608,624 | B2 * | 12/2013 | Shabodyash | A63B 21/4037 482/54 |
| 11,439,548 | B1 * | 9/2022 | Nelson | A61G 5/14 |

(Continued)

FOREIGN PATENT DOCUMENTS

GB 2494868 A * 3/2013 ..... A61G 5/14

*Primary Examiner* — David E Allred

(74) *Attorney, Agent, or Firm* — Law Office of Jeff Williams PLLC; J. Oliver Williams

(57) ABSTRACT

Embodiments of the present invention disclose a lift chair assembly for assisting a user to transition between sitting and standing. The assembly includes a frame body, a backrest member coupled to the frame body, a seat member coupled to the frame body and configured to pivot about an axis relative to the frame body independently from the backrest member such that the seat member pivots between a neutral position and an elevated position, a motor that selectively pivots the seat member, and a controller that selectively engages the motor to pivot the seat member.

17 Claims, 10 Drawing Sheets

(56) References Cited

U.S. PATENT DOCUMENTS

| | | | | |
|---|---|---|---|---|
| 2003/0047973 | A1* | 3/2003 | Pellerin | A61G 5/14 297/260.2 |
| 2010/0219668 | A1* | 9/2010 | Nelson | A61G 5/14 4/479 |
| 2011/0084529 | A1* | 4/2011 | Huang | A61G 5/14 297/330 |
| 2011/0121626 | A1* | 5/2011 | Lipford | A61G 5/14 297/330 |
| 2011/0276233 | A1* | 11/2011 | Lofstrand | A61G 5/1075 5/608 |
| 2013/0093230 | A1* | 4/2013 | Yu | A61G 5/14 297/330 |
| 2016/0220432 | A1* | 8/2016 | Ooyama | A61G 5/101 |
| 2018/0271727 | A1* | 9/2018 | Lee | A61G 5/14 |
| 2020/0305661 | A1* | 10/2020 | Song | A61G 5/1002 |
| 2022/0061536 | A1* | 3/2022 | Cooper | A47C 1/0242 |

* cited by examiner

LIFT CHAIR ASSEMBLY

BACKGROUND OF THE INVENTION

1. Field of the Invention

The present application relates to chairs in general, and particularly to lift chairs.

2. Description of Related Art

The aged and disabled frequently have difficulty standing up and sitting down due to weakened muscles and/or poor joint mobility. To assist these persons between sitting and standing, lift chairs have been developed. Typical lift chairs known in the art have a chair body and a lifting mechanism that simultaneously raises and tilts the chair to permit an angle that is easier for a user to transition from sitting and standing. In most cases, the chair body includes a seat, a backrest, and two armrests that are permanently coupled to each other and maintain its configuration during operation; however, such lift chairs that tilt the entire chair body can become unstable. As such these lift chairs require further designs to include counterweights and stability devices, thus adding more components to a system, subsequently affecting manufacturing costs. Although strides have been made to develop lift chairs, some shortcomings remain. Thus, a simplified system is desired that also maintains the safety of the user.

BRIEF SUMMARY OF THE INVENTION

It is an object of the present application to provide a lift chair assembly for assisting a user to transition between sitting and standing, the assembly comprising: a frame body, a backrest member coupled to the frame body, a seat member coupled to the frame body and configured to pivot about an axis relative to the frame body independently from the backrest member such that the seat member pivots between a neutral position and an elevated position, a motor that selectively pivots the seat member, and a controller that selectively engages the motor to pivot the seat member.

Ultimately the invention may take many embodiments. In these ways, the present invention overcomes the disadvantages inherent in the prior art.

The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the various purposes of the present design. It is important, therefore, that the claims be regarded as including such equivalent constructions in so far as they do not depart from the spirit and scope of the present application.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
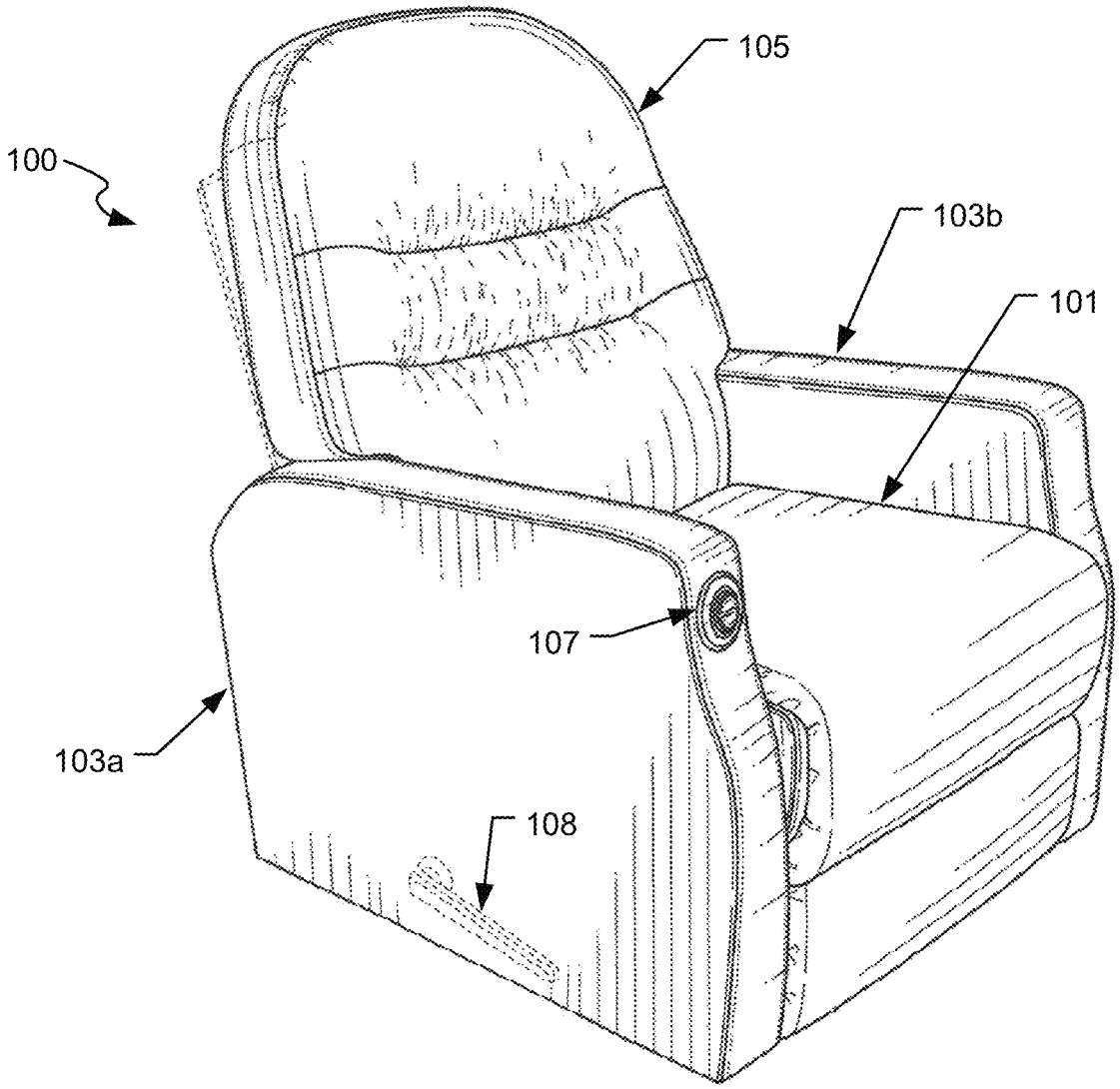
FIG. 1 is a perspective view of a chair assembly with a seat member in a neutral position, in accordance with an embodiment of the present application.

While the embodiments of the present application are susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE INVENTION

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The method and system in accordance with the present invention overcome one or more of the above-discussed problems associated with lift chairs. In particular, the system of the present invention is a lift chair that pivots a seat member independently from a backrest member, thus avoiding having to unnecessarily lift the entire chair during operation.

The method and system will be understood from the accompanying drawings, taken in conjunction with the accompanying description. Several embodiments of the system may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments are expressly contemplated herein so that one of ordinary skill in the art would appreciate from this disclosure that the features, elements, and/or functions of one embodiment may be incorporated into another embodiment as appropriate unless otherwise described.

The system of the present application is illustrated in the associated drawings. As used herein, "system" and "assembly" are used interchangeably. It should be noted that the articles "a", "an", and "the", as used in this specification, include plural referents unless the content clearly dictates otherwise. Additional features and functions are illustrated and discussed below.

Figure 7:
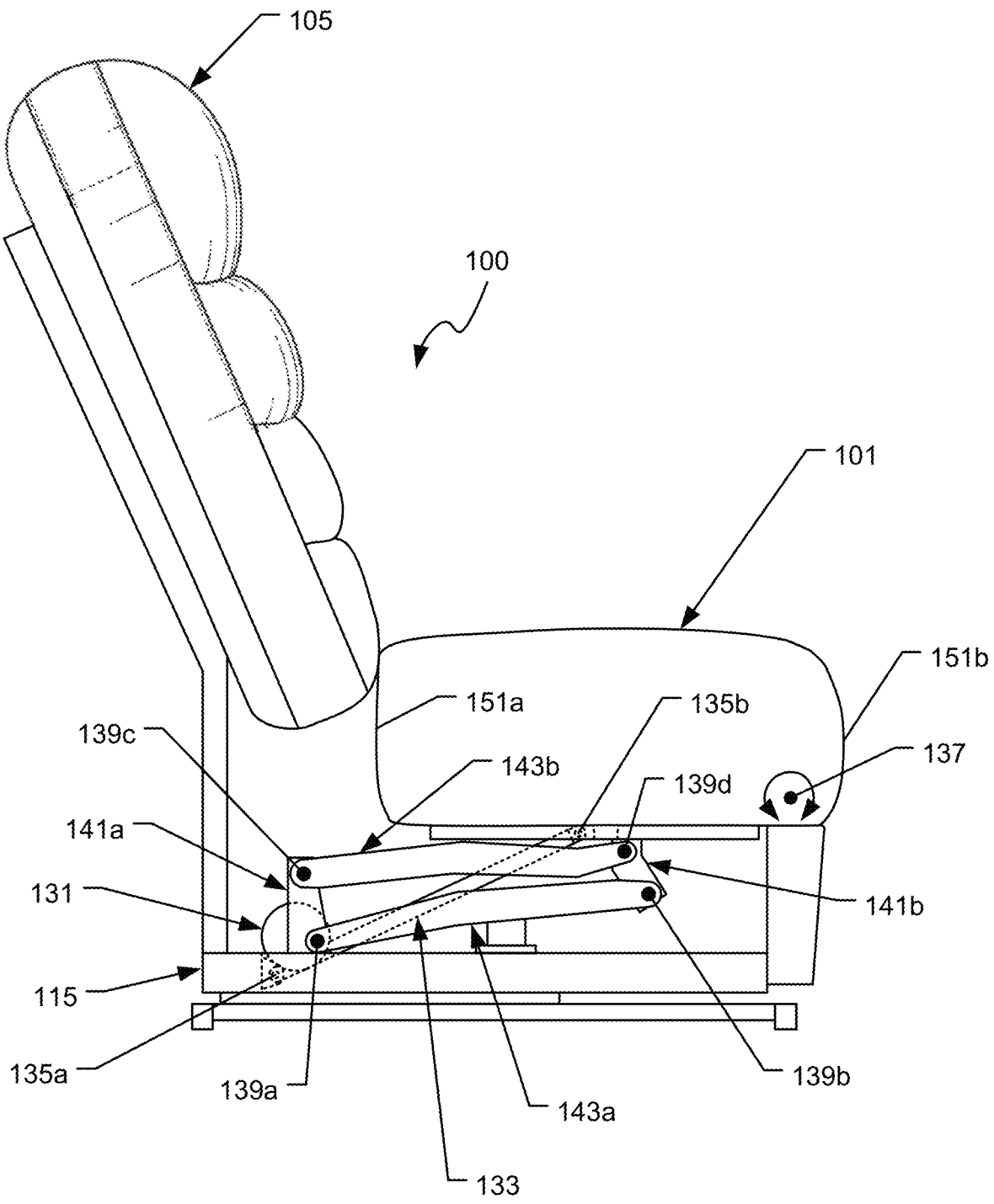
FIG. 7 is a cutaway view of the chair assembly of FIG. 6 with the seat member in the neutral position.
Figure 8:
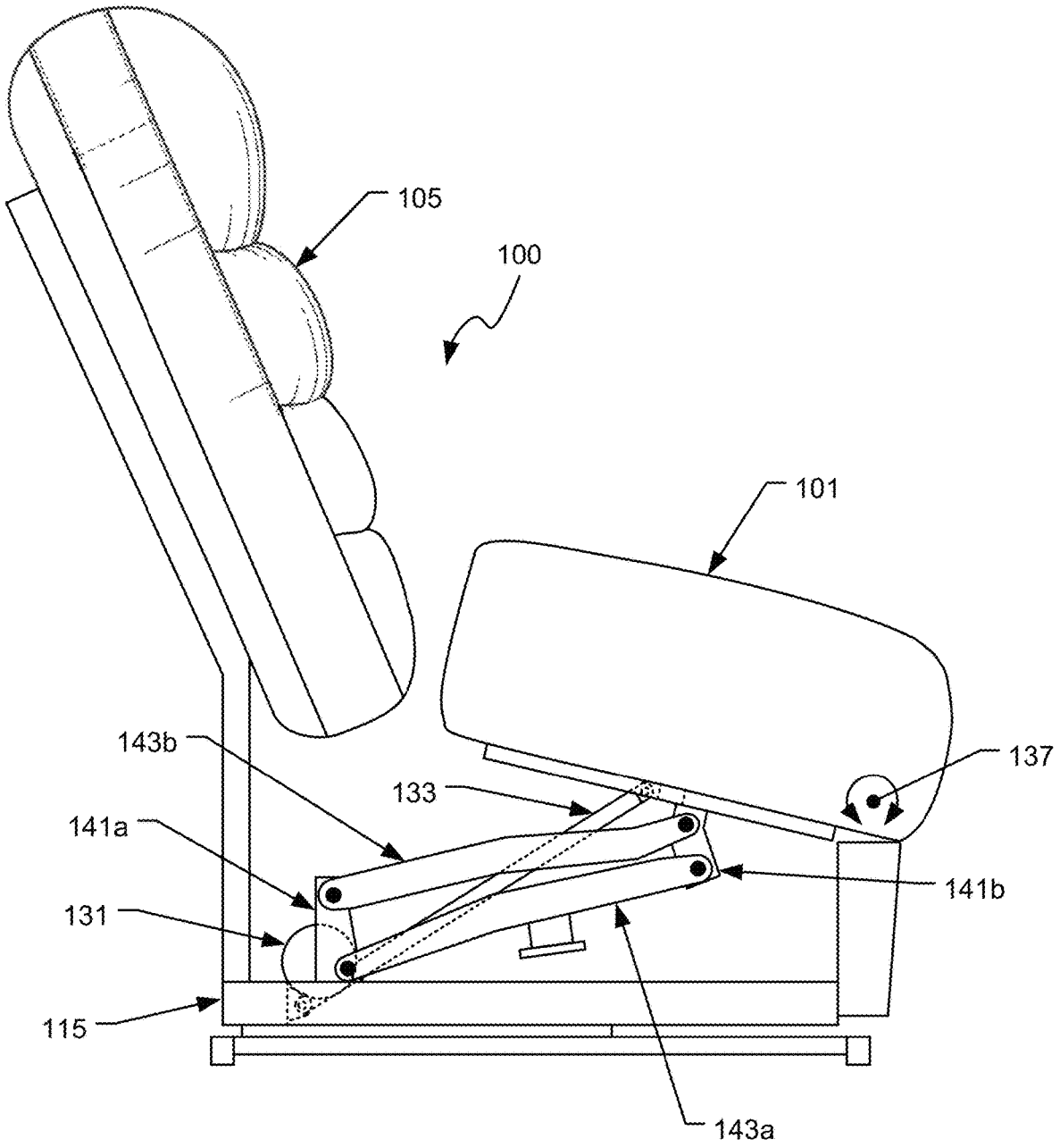
FIG. 8 is a cutaway view of the chair assembly of FIG. 6 with the seat member located between the neutral and elevated positions.
Figure 9:
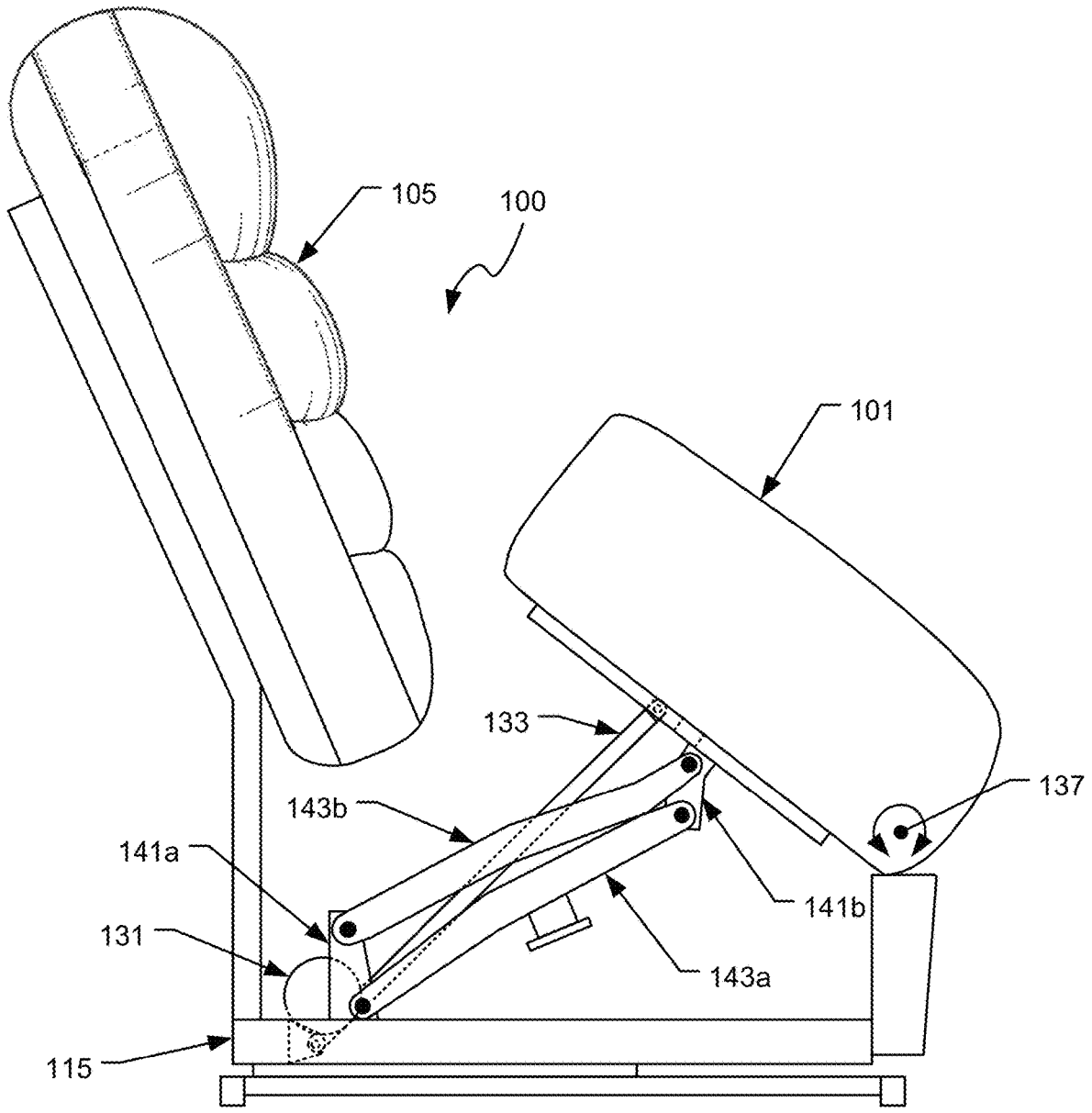
FIG. 9 is a cutaway view of the chair assembly of FIG. 6 with the seat member in the elevated position.

Referring now to the drawings wherein like reference characters identify corresponding or similar elements in form and function through the several views. FIGS. 1-6 illustrate external views of a lift chair assembly. FIGS. 7-9 illustrate the internal components of the lift chair assembly.

Referring now to FIG. 1, a perspective view of chair assembly 100 with a seat member in a neutral position is illustrated in accordance with an embodiment of the present invention.

In FIG. 1, chair assembly 100 is a lift chair comprising seat member 101, backrest 105, armrests 103*a-b*, each in communication with a frame body that structurally maintains the lift chair. In this figure, controller 107 is integrated on armrest 103*a*, wherein controller 107 has button inputs for controlling several features of chair assembly 100 including, but not limited to, selectively engaging a motor that pivots seat member 101 about an axis, regulating the driving speed of the motor, and regulating the direction of the motion of the seat member. Further connections and enabling components are further depicted in FIGS. 7-9. In this figure, seat member 101 is in a neutral position, wherein the neutral position is a configuration typically found with chairs suitable for a user to sit.

Optionally, chair assembly 100 may include brake lever 108 that is pivotably connected the frame body, wherein brake lever 108 is in communication with a set of brake members that are configured to selectively resist a base member from pivoting and/or translating with respect to the frame body. Brake lever 108 and its features are further illustrated and described in FIGS. 3-5.

Figure 2:
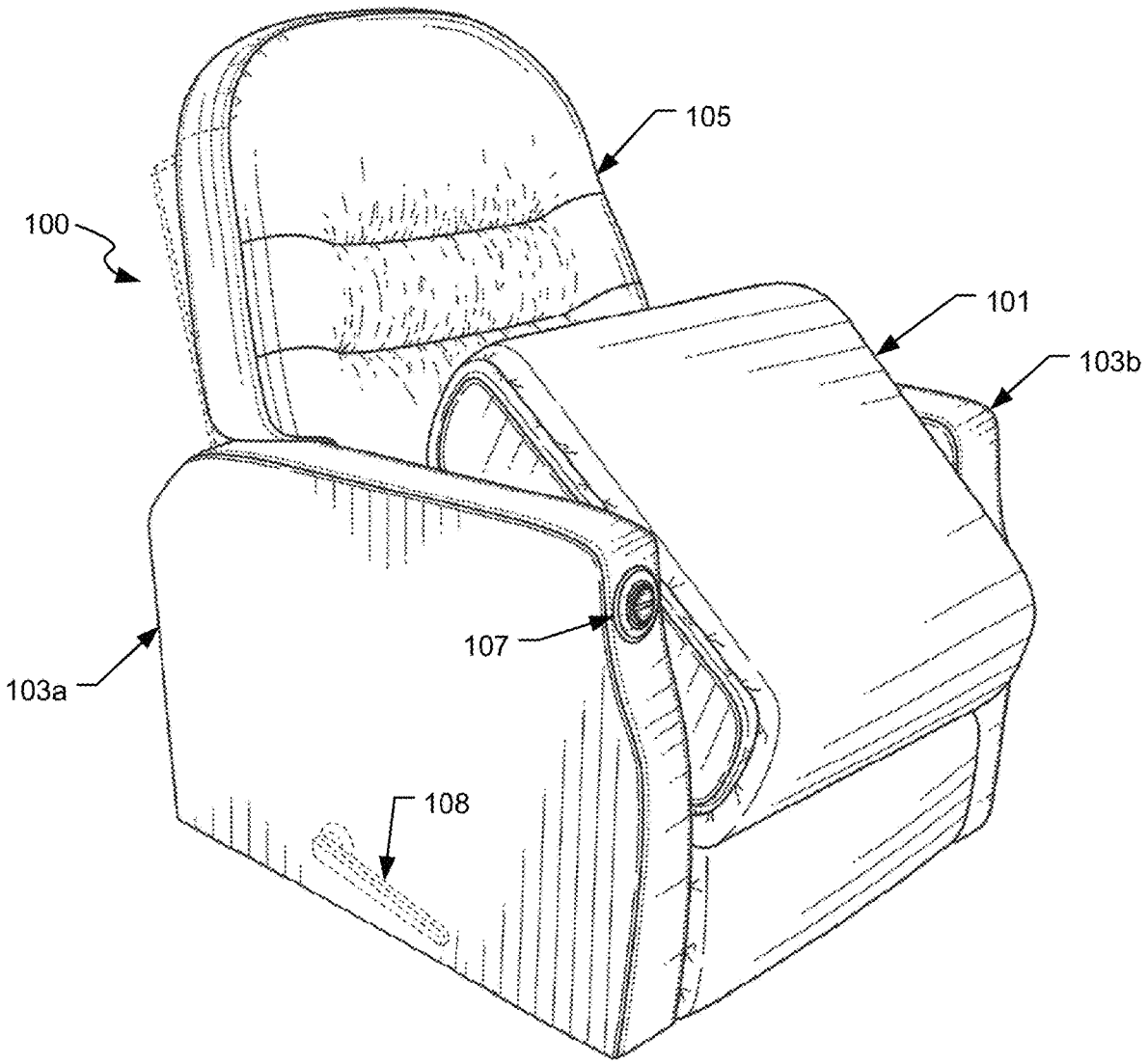
FIG. 2 is a perspective view of the chair assembly of FIG. 1 with the seat member in an elevated position.

Referring now to FIG. 2, a perspective view of chair assembly 100 with a seat member in an elevated position is illustrated.

In general, chair assembly 100 operates as a lift chair by having the seat member coupled to a frame body and configured to pivot about an axis relative to the frame body independently from a backrest member such that the seat member pivots between a neutral position and an elevated position, wherein the elevated position permits a user to transition between sitting and standing with ease by reducing musculoskeletal stress on the user. In FIG. 2, seat member 101 is in an elevated position.

Figure 3:
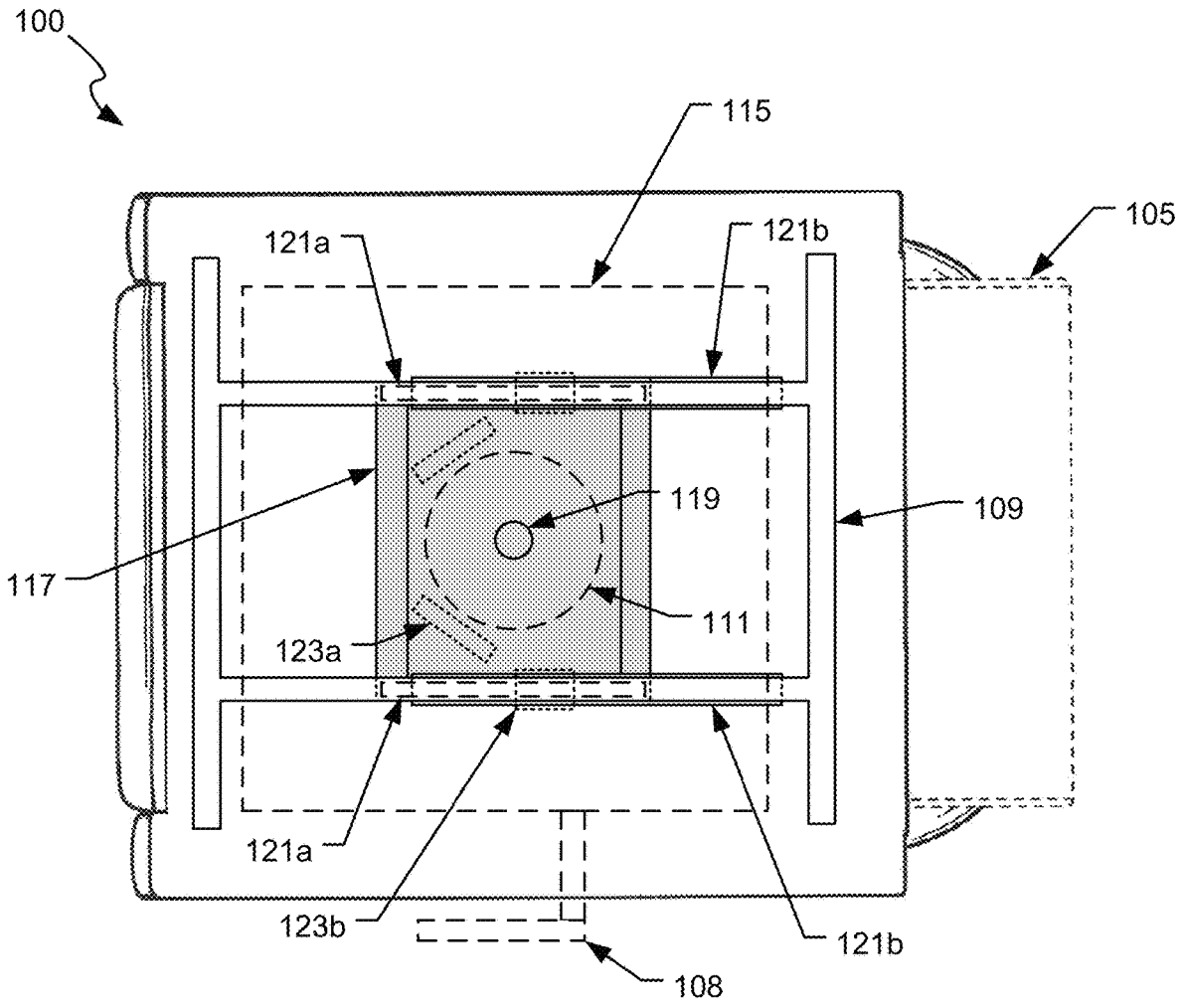
FIG. 3 is a bottom view of the chair assembly of FIG. 1 illustrating a base member.
Figure 4:
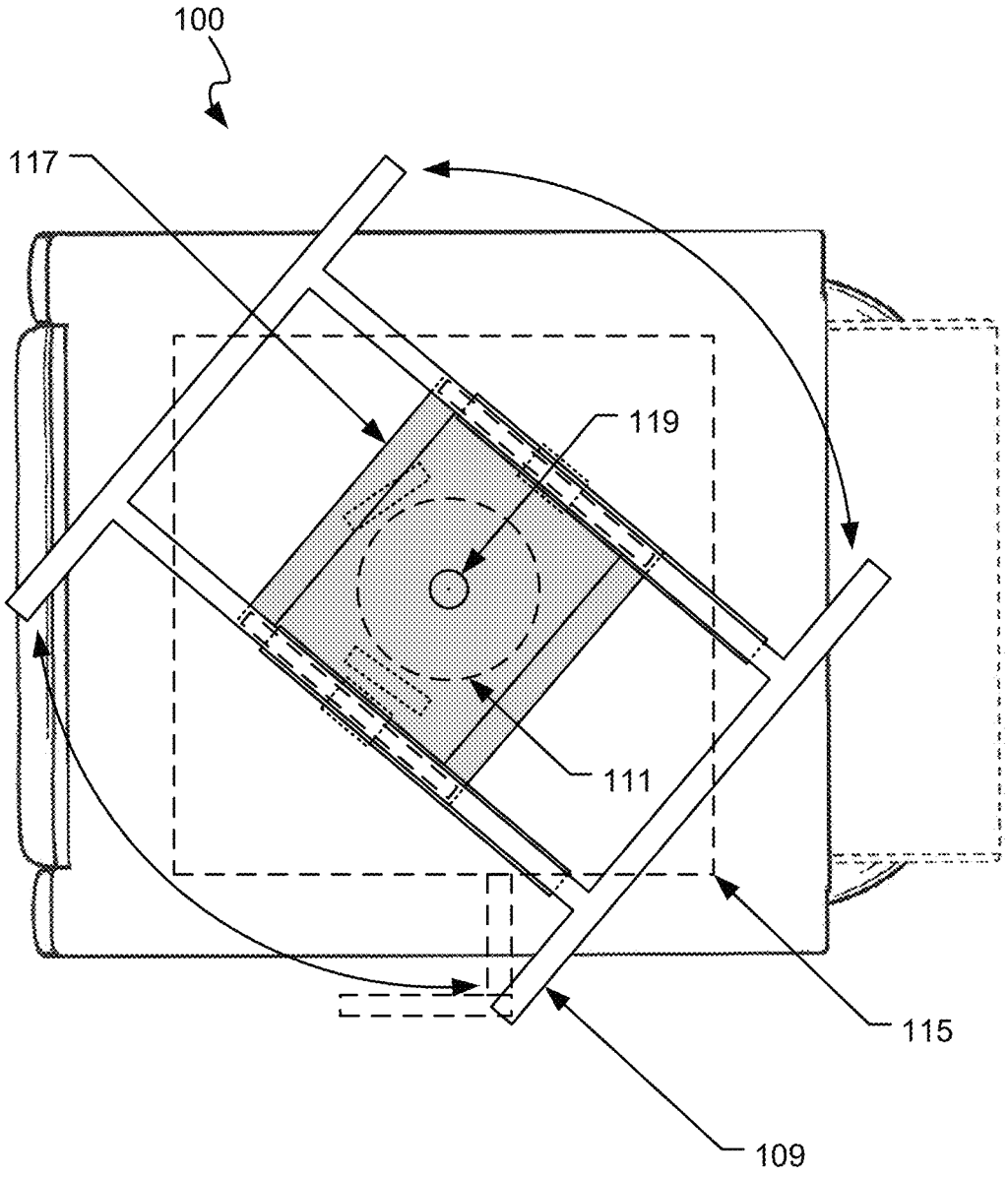
FIG. 4 is a bottom view of the chair assembly of FIG. 1 illustrating rotation of the base member.
Figure 5:
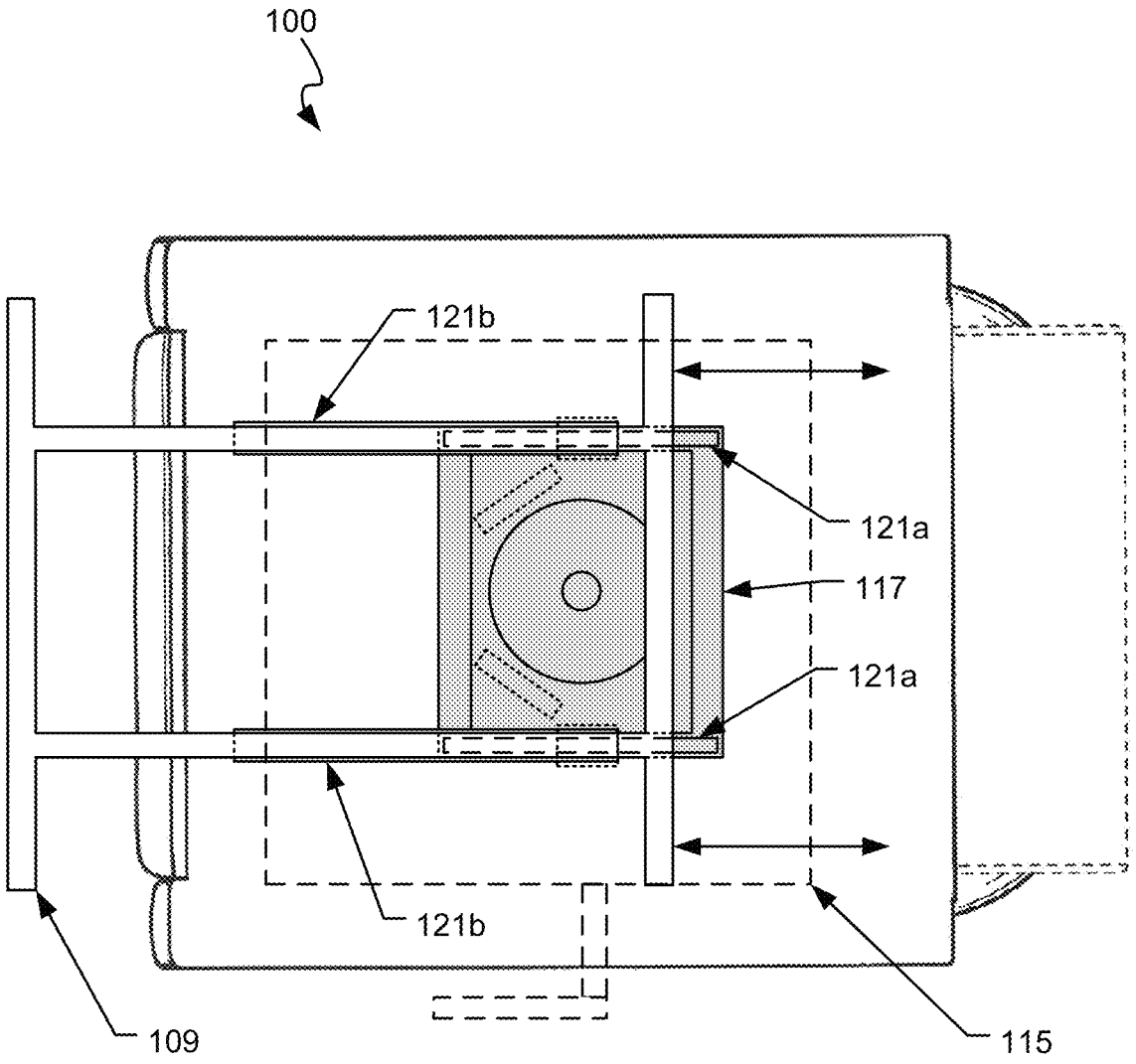
FIG. 5 is a bottom view of the chair assembly of FIG. 1 illustrating translation of the base member.

Referring now to FIGS. 3-5, a bottom view of chair assembly 100 is illustrated to demonstrate the optional features of a base member.

In FIGS. 3-5, base member 109 is in communication with frame body 115, wherein base member 109 is configured to pivot about axis 119 relative to frame body 115, and wherein pivoting about axis 119 rotates the orientation of frame body 115, backrest 105, and seat member 101. In these figures, base member 109 is coupled to swivel plate 117, swivel plate 117 is coupled to hinge 111 (having axis 119), and hinge 111 is likewise coupled to frame body 115, thereby permitting coupled base member 109 and swivel plate 117 to pivot about axis 119 relative to frame body 115 by virtue of hinge 111.

In FIGS. 3-5, frame body 115 is configured to translate along base member 109. For example, in FIGS. 3-5, base member 109 is coupled to swivel plate 117 using a set of track co-members 121*a-b*, wherein track member 121*a* is coupled to swivel plate 117 and track member 121*b* is coupled to base member 109, and wherein track co-members 121*a-b* are configured to translate linearly with respect to each other via roller bearings.

FIG. 3 depicts chair assembly 100 in a neutral position.

FIG. 4 illustrates coupled swivel plate 117 and base member 109 permitted to pivot with about axis 119 with respect to frame body 115 by virtue of hinge 111.

FIG. 5 illustrates base member 109 permitted to translate with respect to frame body 115 by virtue of track co-members 121*a-b* coupled between base member 109 and swivel plate 117.

Optionally, chair assembly 100 includes a brake lever that is pivotably connected to frame body 115, wherein the brake lever is in communication with a set of brake members that are configured to selectively resist base member 109 from pivoting and/or translating with respect to frame body 115. For example, in FIG. 3, chair assembly 100 includes brake lever 108, brake member 123*a*, and brake member 123*b*, wherein brake lever 108 is in communication with brake members 123*a-b*.

In this figure, brake lever 108 is pivotably connected to frame body 115. In general, brake member 123*a* is located between frame body 115 and base member 109. In this example, brake member 123*a* is coupled to frame body 115 and selectively engages against swivel plate 117 to resist swivel plate 117 from pivoting about axis 119. In this figure, brake member 123*a* is configured to selectively resist base member 109 from pivoting about axis 119, wherein rotation of brake lever 108 corresponds to brake member 123*a* selectively resisting base member 109 from pivoting about axis 119.

In general, brake member 123*b* is located between frame body 115 and base member 109. In this example, brake member 123*b* is coupled to swivel plate 117 and selectively engages against base member 109 to resist base member 109 from translating with respect to swivel plate 117. In this figure, brake member 123*b* is configured to selectively resist base member 109 from translating with respect to frame body 115, wherein rotation of brake lever 108 corresponds to brake member 123*b* selectively resisting base member 109 translating with respect to frame body 115.

Figure 6:
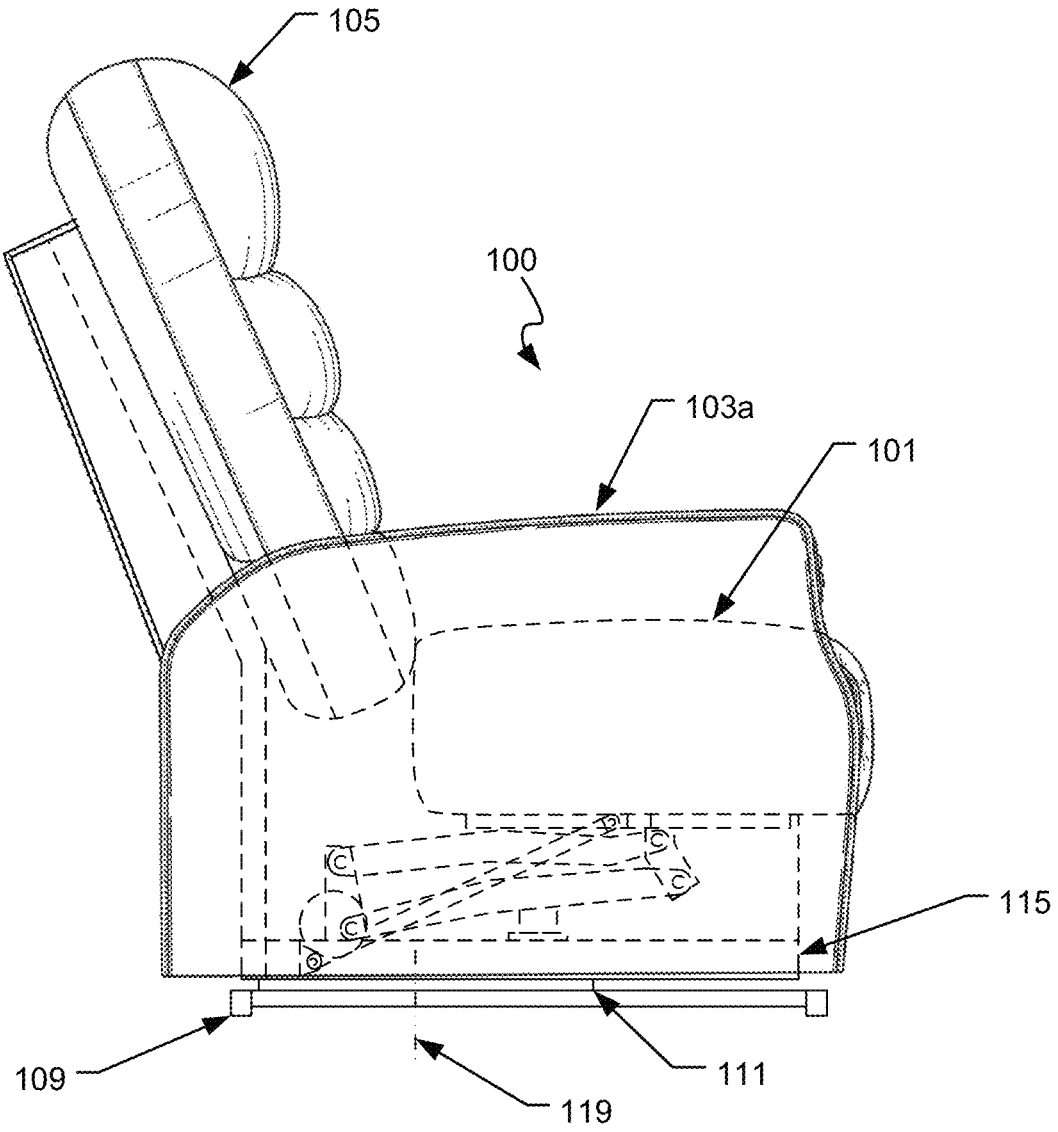
FIG. 6 is a side view of the chair assembly of FIG. 1.

Referring now to FIG. 6, a side view of chair assembly 100 is depicted.

In this figure, internal components of chair assembly 100 are depicted in relation to seat member 101, armrest 103*a*, backrest 105, chair frame 115, all interconnected via frame body 115, as well as depicting the optional features of base member 109 and hinge 111 that permits frame body 115 to pivot about axis 119. Internal components of chair assembly 100 are further detailed with respect to FIGS. 7-9.

Referring now to FIG. 7, a cutaway view of chair assembly 100 with the seat member in a neutral position is depicted.

In general, chair assembly further comprises frame body 115, backrest member 105, seat member 101, and motor 131. In general, chair assembly 100 has backrest 105 rigidly coupled to frame body 115. Seat member 101 is coupled to frame body 115 and is configured to pivot about axis 137 relative to frame body 115 such that seat member 101 is permitted to pivot independently from backrest member 105. Motor 131 is in mechanical communication between frame body 115 and seat member 101, wherein motor 131 selectively pivots seat member 101 about axis 137.

In this Figure, motor 131 pivots seat member 101 via a screw jack 133, wherein screw jack 133 has opposing ends 135*a-b* coupled between frame body 115 and seat member 101. In this Figure, motor 131 is coupled to seat member 101 between opposing ends 151*a-b* of seat member 101.

Seat member 101 includes, but is not limited to, brackets 141*a-b* and linkage members 143*a-b*. In this figure, bracket 141*a* is coupled to frame body 115, bracket 141*b* is coupled to seat member 101, and linkage members 143*a-b* are pivotably connected between brackets 141-*b*. In other words, linkage member 143*a* is coupled to bracket 141*a* and is permitted to pivot about axis 139*c* relative to bracket 141*a*, linkage member 143*a* is coupled to bracket 141*b* and is permitted to pivot about axis 139*d* relative to bracket 141*b*, linkage member 143*b* is coupled to bracket 141*a* and is permitted to pivot about axis 139*a* relative to bracket 141*a*, and linkage member 14*b* is coupled to bracket 141*b* and is permitted to pivot about axis 139*b* relative to bracket 141*b*. The coupled combination of brackets 141*a-b* and linkage members 143*a-b* with associated axis 139*a-c* result in seat member 101 being restricted to a degree of freedom such that seat member 101 pivots about axis 137.

Referring now to FIGS. 8 and 9, a cutaway view of chair assembly 100 with seat member 101 in transit between the neutral and the elevated positions is depicted in FIG. 8 and the seat member 101 located at an elevated position is depicted in FIG. 9. In these figures, motor 131 pivots seat member 101 about axis 137 by expanding or contracting screw jack 133, wherein the combination of brackets 141*a-b* and linkage members 143*a-b* restrict seat member 101 to pivot about axis 137.

Figure 10:
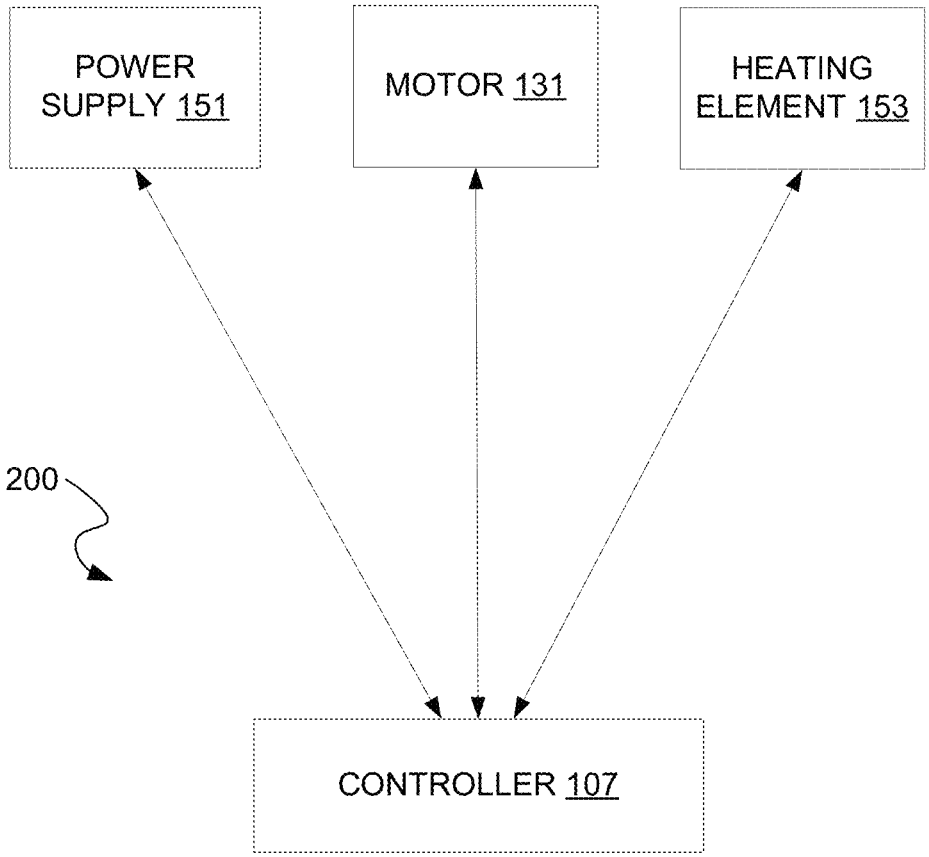
FIG. 10 is a functional block diagram illustrating a network environment.

Referring now to FIG. 10, a functional block diagram illustrating a network environment 200 is depicted.

In this figure, power supply 151, motor 131, and controller 107 are electrically interconnected via wire connections. Power supply 151 can be a battery or electrical power transformer that supplies electrical power to the components depicted in network environment 200. Controller 107 is a controller that operates motor 131, wherein controller 107 operation of motor 131 includes, but it not limited to, regulating the speed of the motor and regulating the direction of motion of seat member 101. Optionally, controller 107 and control heating element 153, wherein heating element 153 is a seat heater located within seat member 101.

As a method of use for chair assembly 101, a user sits on seat member 101 of chair assembly 100. In this step, the user sits on seat member 101 by leaning on seat member 101 of the chair assembly while seat member 101 is in an elevated position, then engaging motor 131 via controller 107, wherein engagement of motor 131 pivots seat member 101 towards backrest member 105. Alternatively, the user may directly sit in seat member 101 while seat member 101 is in a neutral position.

To exit chair assembly 100, the user engages motor 101 via controller 107, wherein engagement of motor 131 pivots seat member 101 to an elevated position away from backrest member 105, and then separates from seat member 101 by standing.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A chair assembly, comprising:

a frame body;

a backrest member and a pair of armrests coupled to the frame body;

a base member including a pair of track members defining a length and a swivel plate, the swivel plate configured to longitudinally translate along the length relative to the base member via the pair of track members;

a swivel mechanism defining a vertical axis, the swivel mechanism coupled to the frame body and the swivel plate, the swivel mechanism allowing the frame body to rotate about the vertical axis relative to the base member;

a seat member pivotally coupled to the frame body and configured to pivot about a horizontal axis relative to the frame body independently from the backrest member and the pair of armrests such that the backrest member and the pair of armrests fail to move when the seat member is pivoting, the seat member pivoting between a neutral position and an elevated position;

a motor in mechanical communication with the frame body and the seat member, wherein the motor selectively pivots the seat member about the horizontal axis relative to the frame body; and a controller in electrical communication with the motor, wherein the controller selectively engages the motor to pivot the seat member about the horizontal axis;

wherein the seat member is configured to be pivoted between the neutral position and the elevated position at any longitudinal position and at any rotational orientation of the frame body relative to the base member.

2. The assembly of claim 1, wherein the motor is coupled with the frame body and the seat member and further comprises a screw jack.

3. The assembly of claim 2, wherein the screw jack has opposing ends coupled to the frame body and the seat member.

4. The assembly of claim 1, wherein the motor is coupled to the seat member between opposing ends of the seat member.

5. The assembly of claim 1, wherein the seat member further comprises:

a first bracket coupled to the frame body;

a second bracket member coupled to the seat member; and a set of linkage members pivotably connected to the first bracket and pivotably connected to the second bracket.

6. The assembly of claim 1, wherein the controller regulates the speed of the motor.

7. The assembly of claim 1, wherein the controller regulates the direction of motion of the seat member.

8. The assembly of claim 1, wherein the base member is coupled to the frame body via the swivel mechanism, the base member configured to pivot about the vertical axis relative to the frame body, pivoting about the vertical axis rotates the orientation of the backrest member and the seat member collectively.

9. The assembly of claim 8, wherein the frame body is configured to translate along the base member.

10. The assembly of claim 8, wherein the controller regulates the speed of the motor.

11. The assembly of claim 8, wherein the controller regulates the direction of motion of the seat member.

12. The assembly of claim 1, wherein the base member is coupled with the frame body via the swivel mechanism, the swivel plate and the frame body configured to translate along a track formed by the pair of track members of the base member.

13. A method of using a chair assembly, comprising:

obtaining the chair assembly of claim 1;

sitting on the seat member of the chair assembly;

engaging the motor via the controller, wherein engagement of the motor pivots the seat member to an elevated position away from the backrest member, the seat member moving relative to fixed positions of the pair of armrests and the backrest member; and separating from the seat member by standing.

14. The method of claim 13, further comprising:

leaning on the seat member of the chair assembly; and engaging the motor via the controller, wherein engagement of the motor pivots the seat member towards the backrest member.

15. The assembly of claim 8, further comprising:

a brake lever pivotably connected to the frame body;

a brake member located between the frame body and the base member, the brake member configured to selectively resist the base member from pivoting about the vertical axis, the brake member coupled with the brake lever, wherein rotation of the brake lever activates the brake member for selectively resisting the base member from pivoting about the vertical axis.

16. The assembly of claim 9, further comprising:

a brake lever pivotably connected to the frame body;

a brake member located between the frame body and the base member, the brake member configured to selectively resist the base member from pivoting about the vertical axis, the brake member coupled with the brake lever, wherein rotation of the brake lever activates the brake member for selectively resisting the base member from pivoting about the vertical axis; and a second brake member located between the frame body and the base member, the second brake member configured to selectively resist the frame body from translating along the base member, the second brake member coupled with the brake lever, wherein rotation of the brake lever activates the second brake member for selectively resisting the frame body from translating along the base member.

17. The assembly of claim 12, further comprising:

a brake lever pivotably connected to the frame body; and a brake member located between the frame body and the base member, the brake member configured to selectively resist the frame body from translating along the base member, the brake member coupled with the brake lever, wherein rotation of the brake lever activates the brake member for selectively resisting the frame body from translating along the base member.

* * * * *